United States Patent [19]

Kobayashi et al.

[11] 4,267,128

[45] May 12, 1981

[54] VARIABLE VENTURI TYPE CARBURETOR

[75] Inventors: Tatuo Kobayashi, Susono; Nobuo Yamada, Kariya, both of Japan

[73] Assignee: Toyota Jidosha Kogyo Kabushiki Kaisha, Aichi, Japan

[21] Appl. No.: 83,830

[22] Filed: Oct. 11, 1979

[30] Foreign Application Priority Data

Apr. 11, 1979 [JP] Japan ..... 54-043037

[51] Int. Cl.[3] ..... F02M 9/06

[52] U.S. Cl. ..... 261/44 C; 267/179

[58] Field of Search ..... 261/44 C, 44 B; 267/179

[56] References Cited

U.S. PATENT DOCUMENTS

| | | | |
|---|---|---|---|
| 446,203 | 2/1891 | Cochennour et al. | 267/179 |
| 1,822,712 | 9/1931 | Skinner | 261/44 C |
| 3,822,058 | 7/1974 | Carter | 261/44 B |
| 3,943,207 | 3/1976 | Haroutian | 261/44 A |
| 3,965,221 | 6/1976 | Englert et al. | 261/44 B |
| 4,148,469 | 4/1979 | Geyer | 267/179 |
| 4,185,054 | 1/1980 | Nakamura et al. | 261/44 C |

FOREIGN PATENT DOCUMENTS

| | | | |
|---|---|---|---|
| 800621 | 11/1950 | Fed. Rep. of Germany | 261/44 B |
| 936721 | 9/1963 | United Kingdom | 261/179 |
| 1394306 | 5/1975 | United Kingdom | 261/44 C |

*Primary Examiner*—Tim R. Miles

*Attorney, Agent, or Firm*—Browdy and Neimark

[57] ABSTRACT

A variable venturi type carburetor is provided having a vacuum generated in the venturi portion in accordance with the throttle valve opening. The vacuum is transmitted into a suction chamber through a vacuum passage so as to balance the force which is the sum of the force exerted by a suction spring and the force exerted by the atmospheric pressure introduced from an atmospheric pressure chamber. The suction piston is set to provide a cross-sectional area of the venturi portion corresponding to the intake air flow rate. The suction piston is provided with a guide groove receiving a guide roller which is rotatably mounted on a guide pin provided on the carburetor casing to oppose to the guide groove. The guide roller is adapted to roll along the guide groove to smooth the movement of the suction piston and prevents the suction piston from being rotated. The combination of the guide roller and the guide groove is free from the problem of wear, even after a long use, so as to ensure an extremely small hysteresis of behaviour of the suction piston and hence a highly accurate adjustment of the air fuel ratio. A suction spring is fixed at its both ends to the suction piston and the suction chamber in a twisted condition so as to bias the suction piston in a circumferential or rotational direction.

8 Claims, 13 Drawing Figures

Fig. 1 PRIOR ART
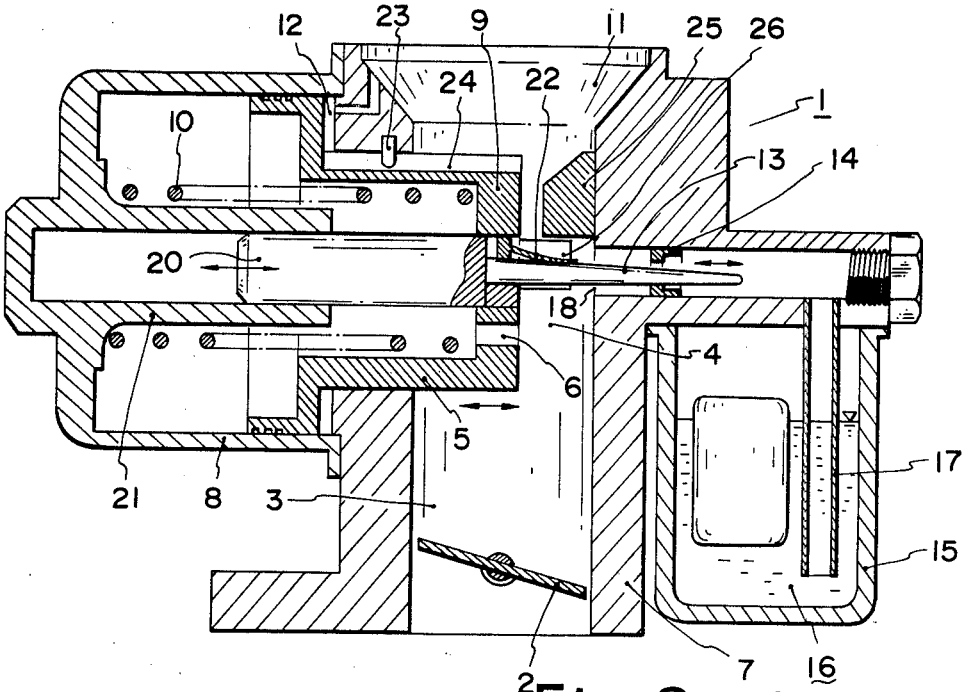
Fig. 3 PRIOR ART
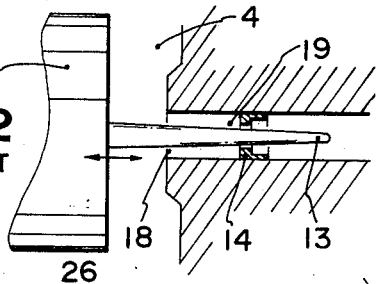
Fig. 2 PRIOR ART
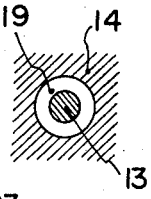
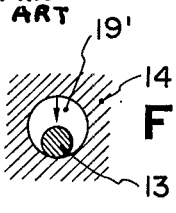
Fig. 4 PRIOR ART
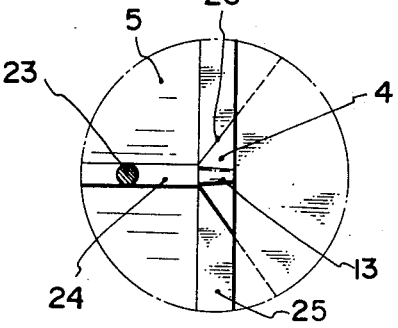
Fig. 5 PRIOR ART
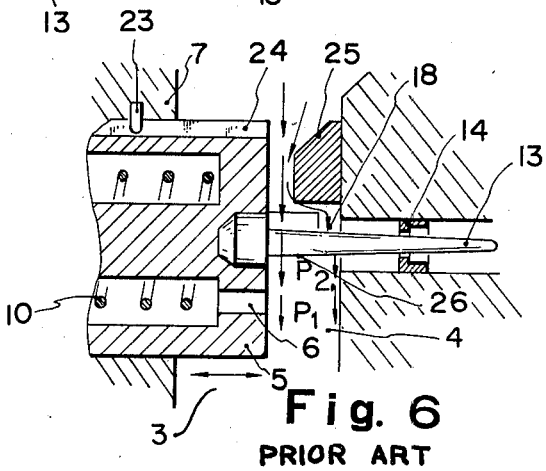
Fig. 6 PRIOR ART Fig. 9
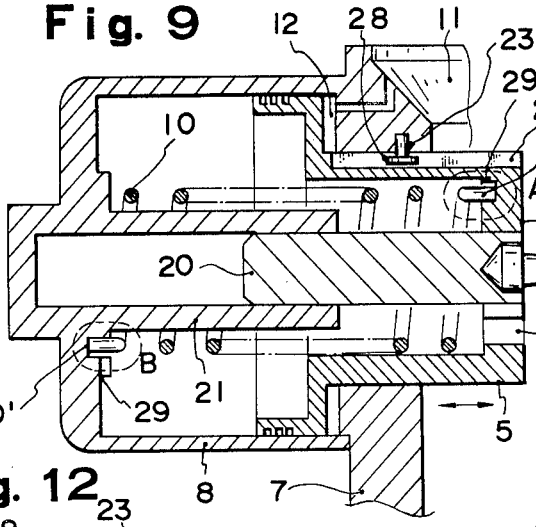
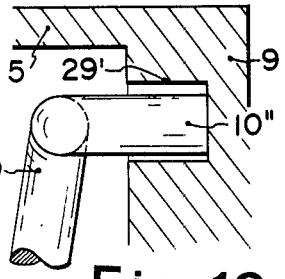
Fig. 10
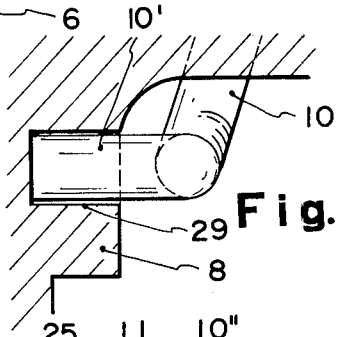
Fig. 11
Fig. 12
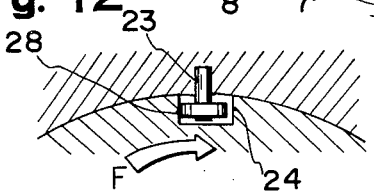
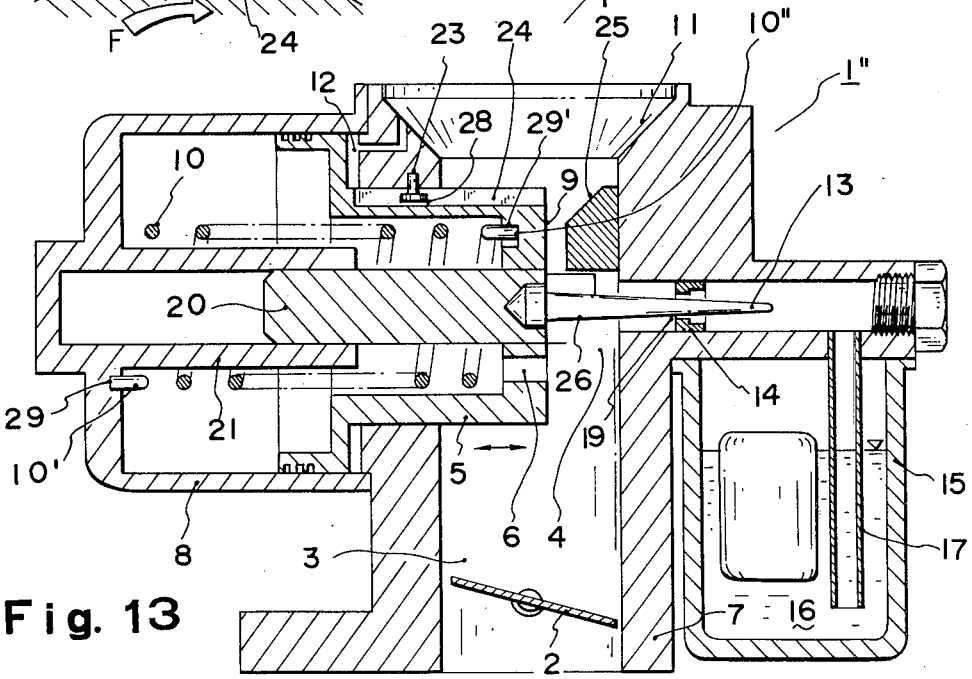
Fig. 13

VARIABLE VENTURI TYPE CARBURETOR

BACKGROUND OF THE INVENTION

1. Field of the Invention

This invention relates to a variable venturi type carburetor for an automobile or the like vehicle, having a suction chamber formed in the venturi portion, a suction piston movably received by the suction chamber and a suction spring disposed between the suction piston and the suction chamber. More specifically, the present invention concerns such a carburetor having a metering jet formed in the venturi portion to oppose to the suction piston and a metering needle provided on the suction piston and wherein a limiting mechanism is provided for preventing change of area of gap around the metering needle in relation to the metering jet.

More particularly, the invention is concerned with a variable venturi type carburetor provided with an axial guide groove formed on the suction piston and a guide roller rotatably carried by a guide pin provided on the casing of the carburetor, the guide roller being adapted to roll along the guide groove, wherein the suction spring is retained at its both ends by the suction chamber and the suction piston in a twisted condition so as to rotatively bias the suction piston.

2. The Prior Art

As is well known, internal combustion engines installed on automobiles or the like vehicles are provided with carburetors. The carburetors are broadly classified into two types: variable venturi type carburetors and fixed venturi type carburetors. These two types are selectively used depending on their characteristics.

The variable venturi type carburetor is becoming popular due to its advantages such as good response characteristic, reduced height and so forth. The use of this type of carburetor has been wide spread in automobile production, not only for sport cars but also for automobiles for ordinary uses, and various changes and improvements of this type of carburetor have been made up to now.

However, the variable venturi type carburetor still involves various drawbacks to be eliminated and problems to be overcome. One of these problems to be overcome arises from vibration of the suction piston in the circumferential direction attributable to the wear down of the suction piston after long use.

To facilitate the understanding of this problem, a typical conventional variable venturi type carburetor is described in detail hereinafter with specific reference to FIGS. 1-6.

As the suction piston is moved into and out of the suction chamber in a conventional variable venturi carburetor, a metering needle provided on the head of the suction piston is moved out of and into a metering jet so as to change the area of annular gap between itself and the metering jet. As a result, a metered amount of fuel is sucked from a float chamber through a suction pipe and delivered to the mixing chamber through a main nozzle.

The fuel is metered automatically by changing the area of the annular gap formed between the metering jet and the metering needle which is moved in a direction perpendicular to the axis of the venturi portion.

However, the designed centering of the metering needle in relation to the metering jet has often failed due to vibration of engine attributable to a racing or the like reason. In such a case, the metering needle is oscillated and vibrated to change the area of the annular gap to cause changes not only in the flow rate of air but also of the stream line and flow resistance, incurring a change in the flow rate of fuel which may result in an engine stall.

Various countermeasures have been taken to avoid this problem. For instance, the metering needle may be biased in one direction by a spring to keep the metering needle in pressure contact with the metering jet to maintain a similar shape of the gap. In addition, in order to prevent the shape of the gap from being changed, the suction piston is prevented from rotating by the engagement of a guide pin with a guide groove.

The prevention of rotation of the metering needle, in combination of preservation of the similar shape of gap between the metering needle and the metering jet is initially effective to make the air flow steady and can theoretically ensure a stable sucking and delivery of the fuel. In fact, this theoretical stable fuel supply is performed at the initial period of use of the engine. However, as the engine is used repeatedly and the time in operation accumulates, the suction piston is likely to stick due to metal powders which are formed due to the wear of parts. In addition, the wear of the guide groove and the guide pin results in play therebetween to deteriorate the rotation-prevention function. In such a case, it is extremely difficult to maintain the similar shape of the gap. Moreover, the metering function becomes deteriorated by the wearing of the metering needle and the metering jet.

As a result, the hystresis of the suction piston is gradually increased; the suction piston being in extreme cases prevented from being reset smoothly, resulting in an engine stall.

In order to improve the starting characteristic at the starting cranking of the engine, an arrangement is employed for a gradual increase of opening of the venturi portion.

In some cases, the suction piston is inconveniently vibrated resulting in serious deterioration of the smooth idling of the engine. This problem can be to a significant degree overcome by proper design.

However, this solution is still unacceptable because the above-stated problem encountered due to the play between the guide pin and the guide groove generated by wears of these parts, results in an engine stall.

SUMMARY OF THE INVENTION

In view of the problem of the conventional variable venturi type carburetor concerning the prevention of rotation of the suction piston, it is the principal object of the present invention to provide an improved variable venturi type carburetor in which the play of the fit between the guide groove and the guide pin in the rotational direction, attributable to the wears of the groove and pin, is avoided by a provision of a guide roller on the guide pin.

It is another object of the present invention to provide an improved variable venturi type carburetor in which the generation of the play is prevented and the gap between the wings and the bridge is reduced as much as possible by imparting a rotational biasing force to the suction piston by suction spring.

The foregoing objects, as well as others, are achieved in accordance with the variable venturi type carburetor having the features set out. The vacuum generated in the venturi portion in accordance with the throttle valve opening is transmitted into the suction chamber through the vacuum passage so as to balance the force which is the sum of the force exerted by the suction spring and the force exerted by the atmospheric pressure introduced from an atmospheric pressure chamber, so that the suction piston is set to provide a cross-sectional area of the venturi portion corresponding to the intake air flow rate. The suction piston is provided with a guide groove receiving a guide roller which is rotatably mounted on a guide pin provided on the carburetor casing to oppose to the guide groove. The guide roller is adapted to roll along the guide groove to smooth the movement of the suction piston and prevents the suction piston from being rotated. The combination of the guide roller and the guide groove is free from the problem of wear, even after a long use, so as to ensure an extremely small hystresis of behaviour of the suction piston and hence a highly accurate adjustment of the air fuel ratio. In addition, the sticking of the suction piston, which has been caused in conventional carburetors by the metal powders generated as a result of wear, is fairly avoided.

Further, according to the invention, the suction spring is fixed at its both ends to the suction piston and the suction chamber in a twisted condition so as to bias the suction piston in a circumferential or rotational direction. Therefore, the guide roller is always kept in good rolling contact with the guide groove at one side wall of the latter. Therefore, the undesirable jolt of the guide roller, which would cause repetitional impacting contact of the roller with both side walls of the groove, is conveniently avoided to diminish the local wear. Such a jolt would be caused due to a vibration of the engine during racing or high-speed running.

In addition, since the gap between the bridge and the wings are reduced as much as possible, the vibration of the suction piston in cranking or idling is prevented to avoid a sudden change of air-fuel ratio.

BRIEF DESCRIPTION OF THE DRAWING

FIG. 1 is a sectional view of a conventional variable venturi type carburetor;

FIG. 2 is a sectional view for explaining the relationship between the metering needle and the metering jet in ordinary variable venturi type carburetor;

FIGS. 3 and 4 are cross-sectional views showing the metering needle and the metering jet as shown in FIG. 2;

FIG. 5 is a plan view of a portion of a conventional suction piston, showing particularly wings formed on the suction piston and a bridge for cooperation with the wings;

FIG. 6 is a cross-sectional view corresponding to FIG. 5;

FIG. 9 is a partly-sectioned illustration of a second embodiment of the invention;

FIGS. 10 and 11 are enlarged view of portions A and B as shown in FIG. 9;

FIG. 12 is a cross-sectional view of a guide roller and a guide groove as shown in FIG. 9; and FIG. 13 is a longitudinal sectional view of a third embodiment of the invention.

DESCRIPTION OF THE PREFERRED EMBODIMENTS

Figure 7:
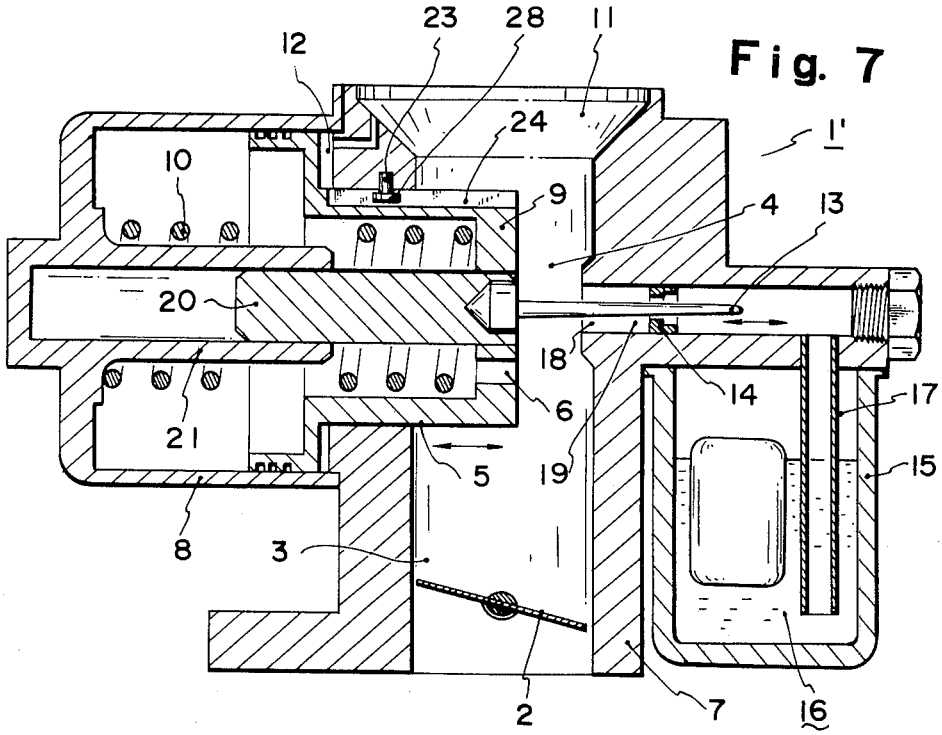
FIG. 7 is a longitudinal sectional view of the whole part of a first embodiment of the invention.

Before turning to the detailed embodiments, to facilitate understanding of the problems solved, a typical conventional variable venturi type carburetor is described hereinunder in detail with specific reference particularly to FIG. 1. Referring to FIG. 1, a conventional carburetor has a venturi portion 4 downstream from a mixing chamber 3 upstream from a throttle valve 2 which is adapted to be opened and closed in accordance with the engine demand. A suction chamber 8 is formed in the portion of the carburetor casing 7 defining the venturi portion. The suction chamber 8 movably receives a suction piston 5. A suction piston 10 is disposed between the head 9 of the suction piston 5 and the suction chamber 8.

In operation, the suction piston 5 is moved in the suction chamber 8 to a position where the force of vacuum acting on the suction piston 5, transmitted through a vacuum passage 6, balances the force which is the sum of the force exerted by atmospheric pressure transmitted from an atmospheric changer 12 through an air horn 11 and the force of the suction spring 11. Consequently, the cross-sectional area of the venturi portion 4 is changed in accordance with the flow rate of air sucked by the engine, in the direction perpendicular to the axis of the venturi portion.

As the suction piston is moved into and out of the suction chamber 5, a metering needle 13 provided on the head 9 of the suction piston 5 is moved out of and into a metering jet 14 so as to change the area of annular gap between itself and the metering jet 14, so that a metered amount of fuel is sucked from a float chamber 15 through a suction pipe 17 and delivered to the mixing chamber through a main nozzle 18.

In the illustrated carburetor, the fuel supplying system is so designed and set as to meter the fuel automatically as shown basically in FIGS. 1, 2 and 3, through changing the area of annular gap 19 formed between the metering jet 14 and the metering needle 13 which is moved in a direction perpendicular to the axis of the venturi portion 4.

However, in the variable venturi type carburetor of this type, the suction piston 5 is adapted to be centered with its center rod 20 slided along a rod guide 21 of the suction chamber 8. However, the designed centering of the metering needle 13 in relation to the metering jet 14 is often failed due to vibration of engine attributable to a racing or the like reason. In such a case, the metering needle is oscillated and vibrated to change the area of the annular gap 19 to cause changes not only in the flow rate of air but also of the stream line and flow resistance, incurring a change in the flow rate of fuel which may result in an engine stall.

Various countermeasures have been taken to avoid this problem, typical examples of which are shown in FIGS. 1 and 4. For instance, the metering needle 13 is biased in one direction by a spring 22 to keep the metering needle 13 in pressure contact with the metering jet 14 so as to maintain a similar shape of the gap 19' between the metering jet and the metering needle. In addition, in order to prevent the similar shape of the gap 19' from being changed, a guide pin 23 provided on the casing 7 is received by a guide groove 24 which is formed axially on the suction piston 5, such that the suction piston 5 is prevented from rotating by the engagement of the guide pin with the guide groove 24.

The prevention of rotation of the metering needle, in combination of preservation of the similar shape of the gap 19' between the metering needle 13 and the metering jet 14 is initially effective to make the air flow steady and can theoretically ensure a stable sucking and delivery of the fuel. In fact, this theoretical stable fuel supply is performed at the initial period of use of the engine. However, as the engine is used repeatedly for periods of time, the suction piston 5 is likely to stick due to metal powders which are formed due to the wear of parts attributable to the friction between the guide pin 23 and the guide groove 24 and also the frictional sliding movement between of the metering jet 13 relative to the metering jet 14. In addition, the wear of the guide groove 24 and the guide pin 23 causes a play therebetween to deteriorate the rotation-prevention function. In such a case, it is extremely difficult to maintain the similar shape of the gap 19'. Further, the metering function becomes deteriorated by the wearing of the metering needle 13 and the metering jet 14.

Consequently, the hystresis of the suction piston 5 is gradually increased. In the worst case, the suction piston is prevented from being reset smoothly, resulting in an engine stall.

In order to improve the starting characteristic at the starting cranking of the engine, an arrangement is employed for a gradual increase of opening of the venturi portion 4. This is achieved, as shown in FIGS. 1, 5 and 6, by forming a bridge 25 on the casing 7 defining the venturi portion 4 so as to oppose to the suction piston 5, and providing diverging underhung wings 26, 26 underlying the bridge 25, on the head 9 of the suction piston 9.

In this type of carburetor, however, the air flowing from the air horn 11 to the mixing chamber 3 is shunted into a flow component P1 which flows straight through the rectangular venturi portion 4 and a flow component P2 which flows through the gaps between the surfaces of the bridge 25 and the wings 26, 26. When the flow of intake is small, i.e. when the suction piston has been moved to the closing position or nearly to the closing position, the latter flow component P2 is dominant. The flow component P2 becomes more dominant as the gap between the bridge 25 and the wings 26, 26 is increased. Therefore, it is conceivable that the suction piston 5 cannot be moved from that position in the opening direction. In some cases, the suction piston 5 is inconveniently vibrated to deteriorate the smooth idling of the engine.

This problem can be overcome, as a matter of design, by reducing the gap between the bridge 25 and the wings 26, 26 down to a level as small as 0.2 to 0.3 mm.

However, this solution is still unacceptable for the following reason, although it can overcome above-stated problem encountered at the initial period of use of the engine. Namely, due to the play between the guide pin 25 and the guide groove 24 generated by wears of these parts, the wing 26 locally abuts the bridge 25, also resulting in an engine stall.

Preferred first, second and third embodiments of the invention are hereinunder with respectively reference to FIGS. 7 and 8, FIGS. 9–11 and FIG. 13. In these Figures, the same reference numerals are used to denote the corresponding members or parts as those in FIGS. 1 to 6.

Figure 8:
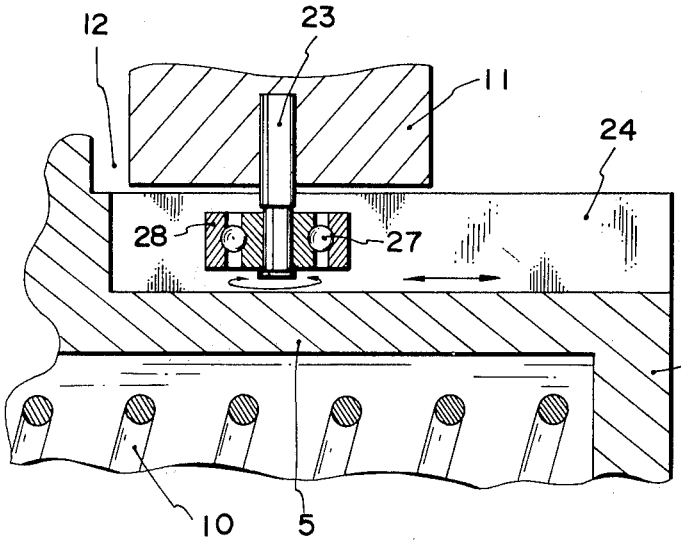
FIG. 8 is an enlarged view of a portion of the embodiment shown in FIG. 7.

Referring first to FIGS. 7 and 8, there is shown a venturi type carburetor 1' of the present invention. In this first embodiment, a casing 11 of a carburetor has an air horn 11 which is disposed at the upstream side of the venturi portion 4 and a throttle valve 2 at the downstream side of the venturi portion 4 across a mixing chamber 3. The carburetor casing 11 has a suction chamber 8 formed at one side thereof. The suction chamber 8 has a rod guide 21 slidably engaging a rod 20 of a suction piston 5 received by the suction chamber 8. A suction spring 10 is disposed between the suction piston 5 and the suction chamber 8. An atmospheric chamber 12 communicating with the air horn 11 is defined between the casing 7 and the suction piston 5. The suction piston 5 is provided with a vacuum passage 6 through which the space in the suction piston 5 is communicated with the venturi portion 4. The suction piston 5 is adapted to be moved into and out of the suction chamber 8 in the direction perpendicular to the axis of the venturi portion 4.

A guide groove 24 of a predetermined breadth and depth is formed in the sliding surface of the suction piston 5 to extend in the axial direction of the latter between the flange to the head 9 of the suction piston 5.

On the other hand, a guide pin 23 is press-fitted to the portion of the casing 7 opposing to the guide groove 24. As shown in FIG. 8, the guide pin 23 carries a guide roller 28 through a roller bearing 27. The guide roller is loosely received by the guide groove 24.

A float chamber 15 is formed in the casing 7 at the opposite side to the suction piston 5. The float chamber accomodates fuel 16 in which dipped is a suction pipe 17 which in turn is communication with a metering jet 14.

A metering needle 13 press-fitted to the head 9 of the suction piston 5 is movably received by the metering jet 14 and is centered to the latter as well as to a main nozzle 18.

In operation, as the throttle valve 2 is opened to a predetermined opening after the start of the engine, the vacuum generated in the mixing chamber 3 and the venturi 4 is transmitted to a vacuum chamber defined in the suction chamber 8, through the vacuum passage 6, so that the suction piston 5 is moved to a position where the force of the vacuum balances the force which is the sum of the force of the suction spring 10 and the atmospheric pressure derived from the atmospheric chamber 12, thereby to define a cross-sectional area of the venturi portion 4 corresponding to the flow rate of the intake air.

The metering needle 13 is moved accompanying the suction piston 5 keeping a centering to the main nozzle 18 and the metering jet 14, so as to allow a sucking of a predetermined amount of fuel together with air.

During the movement of the suction piston 5 toward and away from the metering jet 14, the suction piston 5 is prevented from rotating by the rolling engagement of the guide roller 28 with the guide pin 23. This function of prevention of rotation is achieved, needless to say, even when the engine is vibrated due to a racing or a high-speed operation of the engine.

It will be seen that the metering needle 13 is correctly centered to the main nozzle 18 and the metering needle 14, during its movement toward and away from the metering jet 14, so that the undesirable change of the air-fuel ratio is fairly avoided.

The air-fuel ratio is always stabilized thanks to the diminished hysteresis of the behaviour of the suction piston which is ensured by the anti-wear engagement of the guide roller 28 and the guide groove 24. The anti-wear engagement of the groove 24 and the guide roller 28 also diminish the generation of metal powders which would cause a stick of the suction piston 5 to further ensure a smooth operation of the engine.

FIGS. 9 to 12 show a second embodiment of the present invention in which the construction including the float chamber 15, the main nozzle 18 and the metering jet is identical to that of the first embodiment. Also the guide roller 28 engages the guide groove 24 of the suction piston substantially in the same manner as in the first embodiment. This second embodiment of the invention is distinguished from the first embodiment in the following points. Namely, in this second embodiment, the outer and inner ends 10', 10'' of the spring 10 are fixed in retaining bores 29, 29' formed in the inner end surface of the suction chamber 8 and in the inner surface of the head 9 of the suction piston 5, in a twisted condition to impart a rotational biasing force to the suction piston 5, e.g. a torque F to rotatively bias the suction piston clockwise as viewed in the drawing.

In this embodiment, the suction piston 5 is moved into and out of the suction chamber 8 to attain the balance of force in accordance with the flow rate of the intake air, as in the case of the first embodiment.

Since the suction piston 5 is biased in a circumferential direction by the twisted suction spring 10 retained at its both ends 10', 10'' by corresponding retaining bores 29, 29', during the movement of the suction piston 5, the rolling contact of the guide groove 24 and the guide roller 28 takes place always at one side of the guide groove 24, irrespective of the direction of movement of the suction piston 5, no matter how the carburetor may be used long. In other words, the repeated and alternating collision of the guide roller 28 with both side walls of the groove 24 is avoided to provide a stable operation of the suction piston. Consequently, the hysteresis is further diminished and the fluctuation of the air-fuel ratio is further suppressed.

The carburetor of this embodiment is effective not only in preventing various inconveniences caused by ordinary vibration of the engine but particularly effective in overcoming various problems which would be caused during racing and high-speed operation of the engine to ensure an improved durability and increased stability of operation of the suction piston 5.

Referring now to FIG. 13 showing still another embodiment of the invention, the carburetor of this third embodiment has a construction similar to the carburetor as shown in FIGS. 1, 5 and 6, but is different from the latter in that the bridge 25 is provided on the casing 7 to extend into the upper portion of the venturi portion 4, and that diverging underhung wings 26, 26 are provided at the front portion of the head 9 of the suction piston 5 to underlie the bridge 25.

In this embodiment, the bridge 25 and the wings 26, 26 are so designed as to reduce the gap therebetween as much as possible to a level as small as 0.2 mm to 0.3 mm.

The behaviour of the suction piston in response to the change in the intake air flow rate is identical to that performed by the preceding embodiments. As in the case of the second embodiment, the suction spring 10 is retained at its both ends 10', 10'' by the retaining bores 29, 29' of the suction chamber 8 and the suction piston 5 so as to rotationally bias the suction piston 5 in one direction. Therefore, the rolling contact between the guide roller 28 and the guide groove 24 is made always at one side of the guide groove 24. Namely, undesirable repetitional and alternating collision of the guide roller 28 with both side walls of the guide groove 24 is fairly avoided to diminish the wear of the guide roller 28 and the guide groove 24. Consequently, the wings 26, 26 are always kept in parallel with the surface of the bridge 25 so that the unfavorable local contact of the bridge 25 with the winge 26, 26 is avoided despite of the designed small gap of 0.2 to 0.3 mm between the bridge 25 and the wings 26, 26. Therefore, the flow component of air which passes through the gap between the wings and the bridge is diminished during cranking or idling in which the intake air flow rate is specifically small, and the suction piston 5 can be moved in the opening direction by the air flow component which flows straight through the venturi portion, without being vibrated. As a result, the fluctuation of the engine speed furing idling, as well as the fluctuation of the air-fuel ratio, is conveniently avoided.

Although the invention has been described through its preferred embodiments, these embodiments are not exclusive and various changes and modifications may be imparted thereto.

For instance, a wear-resistant coating layer such as of teflon may be provided on the contacting surface of at least one of the guide roller and the guide groove. It is also possible to use a plurality of guide rollers in combination with the guide groove. It is still possible to provide a plurality of guide grooves in the sliding surface of the suction piston, each of the guide grooves being associated with at least one guide roller.

For retaining and anchoring both ends of the suction spring, the retaining bores which are used in the described embodiments may be filled with an adhesive for preventing the spring ends from being disengaged from these retaining bores. Alternatively, these retaining bores may be formed to have a hook-like shape to cause a force which acts against the biasing force of the spring. It is also possible to retain both ends of the suction spring by means of hook pins attached to the suction chamber and the suction piston. Needless to say, it is possible to use a plurality of suction springs.

As has been described, according to the invention, there is provided a variable venturi type carburetor in having a suction piston received by a suction chamber in the direction perpendicular to the axis of the venturi portion of the carburetor, in accordance with the intake air flow rate, a suction spring acting between the suction chamber and the suction spring, a metering jet opposing to the suction piston, and a metering needle attached to the suction piston and loosely received by the metering jet in a centered relation to the latter, characterized in that at least one guide roller rotatably carried by a guide pin on the casing is received by an axial guide groove formed in the peripheral surface of the suction piston so as to roll along the guide groove as the suction piston is moved.

This carburetor offers various advantages as follows. Firstly, the conventional sliding contact between the guide groove and the guide pin is substituted by the rolling contact of the guide roller with the guide groove, so that substantially no wear of associated parts takes place even after the highly frequent repetitional movement of the suction piston to ensure an improved durability of the carburetor. In the conventional carburetors, the metal powders produced by the grinding slide contact tend to come into the gaps between the suction piston and the suction chamber and between the suction piston and the casing to cause a stick of the suction piston resulting in an engine stall. This problem, however, is fairly overcome by the invention, thanks to the above-mentioned rolling contact of the guide roller and the guide groove which exclude the production of the metal powders.

Since the rolling contact of the guide roller and the guide groove exclude the wear, the small hysteresis of the behaviour of the suction piston is maintained for a long period of time. Consequently, the movement of the suction piston is stabilized to ensure a smooth operation of the engine.

Further, it is remarkable that the undesirable jolt of the suction piston in the rotational direction is avoided, because no substantial wear of the guide groove takes place, even when during a vibration of the engine which is liable to occur in racing or high-speed operation of the engine. This in turn preserves the similarity of the shape of the gap between the metering needle and the metering jet to stably maintain the designed air-fuel ratio, and undesirable poor response of the engine operation, tardiness and surging are avoided advantageously also for this reason.

Secondly, since the suction spring is retained at its both ends in a twisted manner by the suction chamber and the suction piston, the suction spring functions not only to drive the suction piston to the position where the forces are balanced, but also to fix the suction piston against the rotation. In addition, the suction spring imparts a rotational biasing force in a circumferential direction to the suction piston to keep the guide groove in rolling contact with the guide roller always at one side wall thereof. Consequently, the undesirable repetitional and alternating collision of the guide roller with both side walls of the guide groove is prevented to preserve a constant posture of the suction piston during the movement of the latter. This in turn excludes, in cooperation with the wearless contact of the guide groove and the guide roller, undesirable jolting of the suction piston in the rotational direction to ensure a good centering of the metering needle in relation to the metering jet and hence the similarity of the shape of the gap formed between the metering needle and the metering jet, thereby to avoid the fluctuation of the air-fuel ratio.

Further, when the carburetor is provided with wings formed on the suction piston and a bridge disposed at the upstream side of the venturi, so as to hasten the opening movement of the suction piston, the gap between the bridge and the wings can be reduced as much as possible to reduce the flow rate of air passing through that gap. Consequently, the suction piston can be moved smoothly in the opening direction, by the force provided by the air flowing straight through the venturi portion. In addition, the undesirable engine stall attributable to the local contact of wings with the bridge is avoided even after a long use of the carburetor. Consequently, the invention offers various advantages such as stabilized idling operation, stabilized adjustment of air-fuel ratio and suppression of the suction piston which in turn ensures a smooth engine operation.

What is claimed is:

1. In a variable venturi type carburetor including a casing and having a suction chamber formed at one side of its venturi portion upstream from a throttle valve, a suction piston movably received by the suction chamber so as to be moved into and out of the suction chamber, suction spring means for biasing the suction piston in one direction, a metering jet formed in another side of the venturi portion opposed to the suction chamber and a metering needle provided on the suction piston facing the metering jet, the improvement comprising at least one axial guide groove formed on said suction piston, at least one guide pin, and at least one guide roller rotatably mounted on said guide pin provided on said casing of the carburetor, said guide roller being operatively positioned to roll in said guide groove, said spring means rotatably biasing said suction piston against said roller.

2. An improved variable venturi type carburetor as claimed in claim 1, wherein at least one of said guide roller and said guide groove is coated with an anti-wear resin.

3. An improved variable venturi type carburetor as claimed in claim 1, wherein said guide grooves are provided in plural each of which being associated with a respective one of said guide rollers.

4. An improved variable venturi type carburetor as claimed in claim 3, wherein each of said guide grooves and each of said guide rollers are coated with said anti-wear resin.

5. An improved variable venturi type carburetor including a casing and having a suction chamber formed at one side of its venturi portion upstream from a throttle valve, a suction piston movably received by the suction chamber, suction spring means for biasing the suction piston in one direction, a metering jet formed in another side of the venturi portion opposed to the suction chamber and a metering needle provided on the suction piston and facing the metering jet, the improvement comprising an axial guide groove formed on said suction piston and at least one guide roller rotatably mounted on at least one guide pin provided on said casing of the carburetor, said guide roller being operatively positioned to roll in said guide groove, and wherein said spring means comprises at least one suction spring, said suction spring being fixed at its respective ends to said suction piston and to said suction chamber, and rotatably biasing said suction piston against said roller.

6. An improved variable venturi type carburetor as claimed in claim 5, wherein each end of said suction spring is retained by a retaining bore provided on either one of the end surface of said suction chamber and said suction piston.

7. An improved variable venturi type carburetor as claimed in claim 5, including a suction spring retaining bore.

8. An improved variable venturi type carburetor as claimed in claim 7, wherein each end of said suction spring is retained by a retaining bore provided on either one of the end surface of said suction chamber and said suction piston.

* * * * *